US007313990B1

(12) United States Patent
Shiao

(10) Patent No.: US 7,313,990 B1
(45) Date of Patent: Jan. 1, 2008

(54) ELECTRONIC TORQUE WRENCH

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 11/636,874

(22) Filed: Dec. 11, 2006

(51) Int. Cl.
*B25B 23/144* (2006.01)
*B25B 23/159* (2006.01)

(52) U.S. Cl. ..... 81/479; 81/483

(58) Field of Classification Search ..... 81/479, 81/467, 483
See application file for complete search history.

(56) References Cited

U.S. PATENT DOCUMENTS 2,924,134 A * 2/1960 Harmes ..... 81/467
4,641,538 A * 2/1987 Heyraud ..... 73/862.26
4,958,541 A * 9/1990 Annis et al. ..... 81/479
6,070,506 A * 6/2000 Becker ..... 81/479
6,119,562 A * 9/2000 Jenkins ..... 81/479
6,276,243 B1 * 8/2001 Jenkins ..... 81/479
6,526,853 B2 * 3/2003 Jenkins ..... 81/479
6,981,436 B2 * 1/2006 Becker et al. ..... 81/479
2005/0204877 A1 * 9/2005 Royko ..... 81/479

* cited by examiner

*Primary Examiner*—David B. Thomas
(74) *Attorney, Agent, or Firm*—Ladas & Parry LLP

(57) ABSTRACT

An electronic torque wrench includes a head portion, a handle portion connected to the head portion and having a tubular wall that defines a receiving space, a strain sensor unit disposed in the head portion, and an indicator unit disposed in the receiving space and including a rotary member having a rotatable portion, a first indicator connected to the tubular wall, and a second indicator fixed to the rotatable portion. The first and second indicators strike each other to produce a sound when the rotatable portion is rotated. A controlling unit is connected electrically to the strain sensor unit and the rotary member, and actuates the rotatable portion to rotate when the strain sensor unit detects a torque that is larger than a reference torque level.

11 Claims, 10 Drawing Sheets

ELECTRONIC TORQUE WRENCH

BACKGROUND OF THE INVENTION

1. Field of the Invention

The invention relates to a wrench, more particularly to an electronic torque wrench.

2. Description of the Related Art

Referring to FIG. 1, a conventional electronic torque wrench, as disclosed in U.S. Pat. No. 4,958,541, includes a ratchet head 1, a deflection beam 2 connected to the ratchet head 1, a plurality of strain gauges 3 fixed to the deflection beam 2, a handle 4 connected to the deflection beam 2, a circuit board 5 disposed within the handle 4 and connected electrically to the strain gauges 3, a tactile indication generator 6 disposed within the handle 4 and connected electrically to the circuit board 5, and a battery 7 disposed within the handle 4 and connected electrically to the circuit board 5 and the indication generator 6. The indication generator 6 has an electric motor 601, and a mass 602 fixed eccentrically to a shaft of the motor 601.

When a user rotates a workpiece (not shown) using the conventional electronic torque wrench, the strain gauges 3 transmit a detected torque to the circuit board 5. If the torque is greater than a reference torque level, the circuit board 5 actuates the motor 601 to rotate the mass 602. Since the mass 602 is eccentrically mounted on the motor 601, it will tend to vibrate the motor 601 as it rotates. The vibration is transmitted to the handle 4, thereby warning the user to stop the operation.

Although the aforementioned conventional electronic torque wrench can achieve its intended purpose, it has the following drawbacks:

Since different users have different sensitivities with respect to the vibration, and since the user may slightly loosen his hold on the handle 4 when the vibration occurs, the user may not feel the vibration, and thus miss the warning.

SUMMARY OF THE INVENTION

Therefore, the object of the present invention is to provide an electronic torque wrench that can produce simultaneously vibration and a warning sound so as to warn a user to stop his operation.

According to this invention, an electronic torque wrench comprises a main body, a strain sensor unit, an indicator unit, and a controlling unit. The main body includes a head portion, and a handle portion connected to the head portion. The handle portion has a tubular wall that defines a receiving space. The strain sensor unit is disposed in the head portion. The indicator unit is disposed in the receiving space, and includes a rotary member having a rotatable portion, a first indicator connected to the tubular wall, and a second indicator fixed to the rotatable portion. The first and second indicators strike each other to produce a sound when the rotatable portion is rotated. The controlling unit is disposed in the main body, and is connected electrically to the strain sensor unit and the rotary member. The controlling unit actuates the rotatable portion of the rotary member to rotate when the strain sensor unit detects a torque that is larger than a reference torque level.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
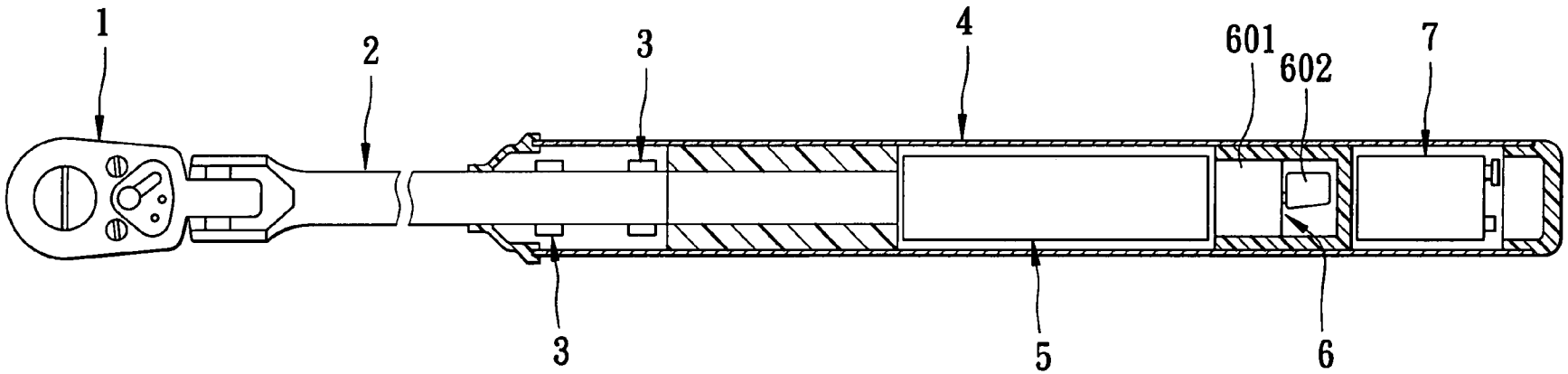
FIG. 1 PRIOR ART
FIG. 1 is a sectional view of a conventional electronic torque wrench disclosed in U.S. Pat. No. 4,958,541.
Figure 2:
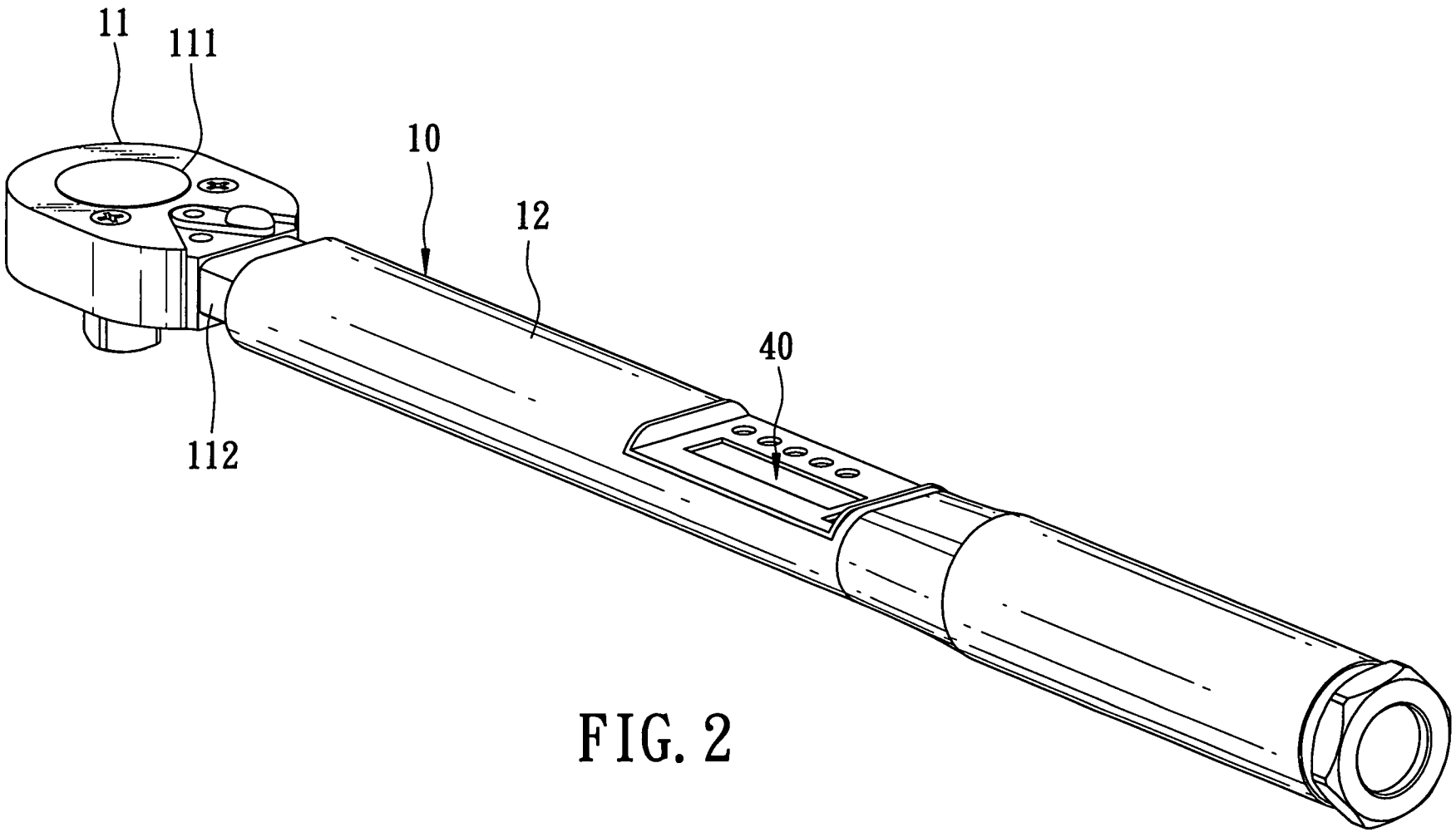
FIG. 2 is a perspective view of the first preferred embodiment of an electronic torque wrench according to the present invention.
Figure 3:
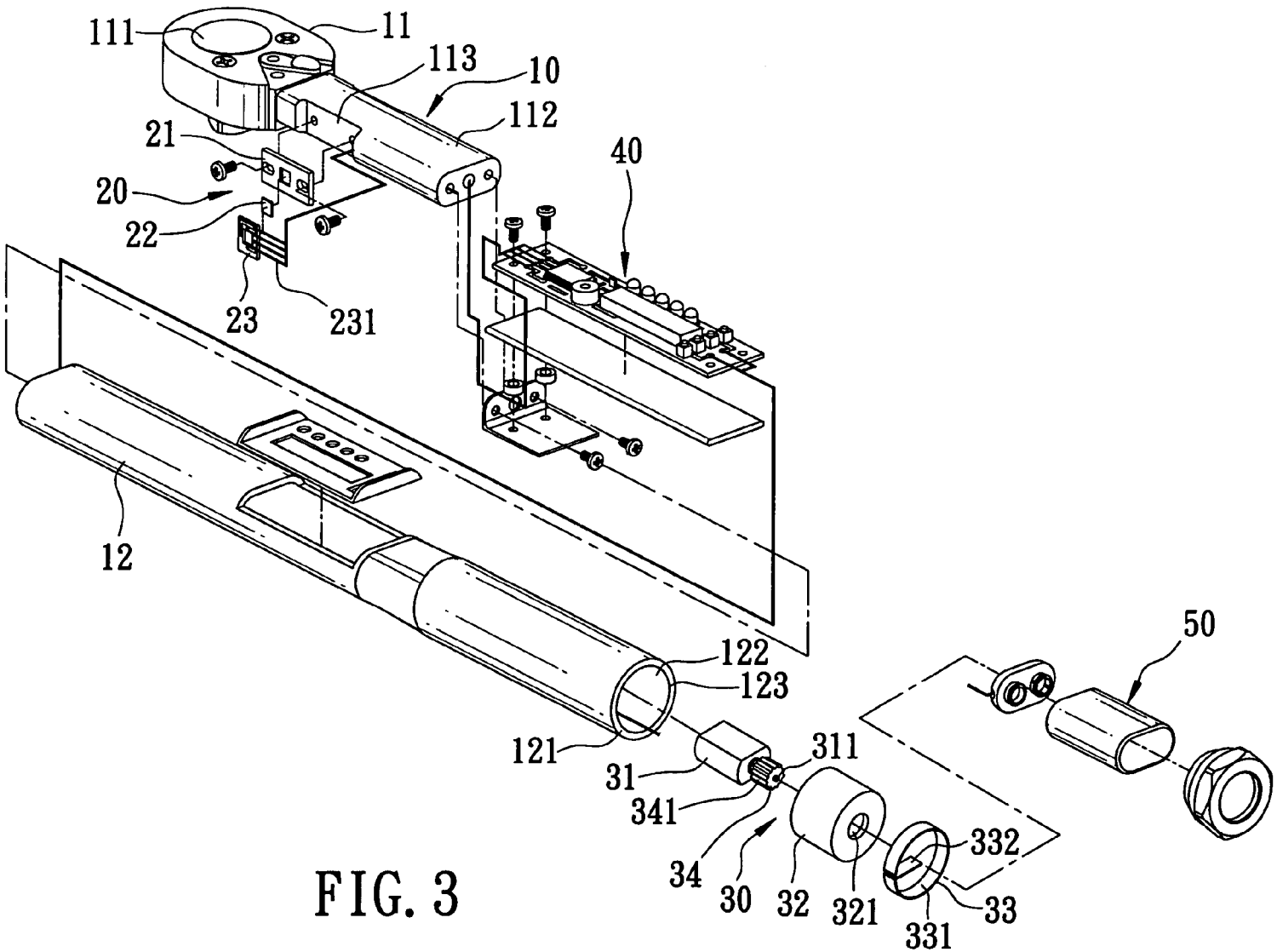
FIG. 3 is an exploded perspective view of the first preferred embodiment.
Figure 4:
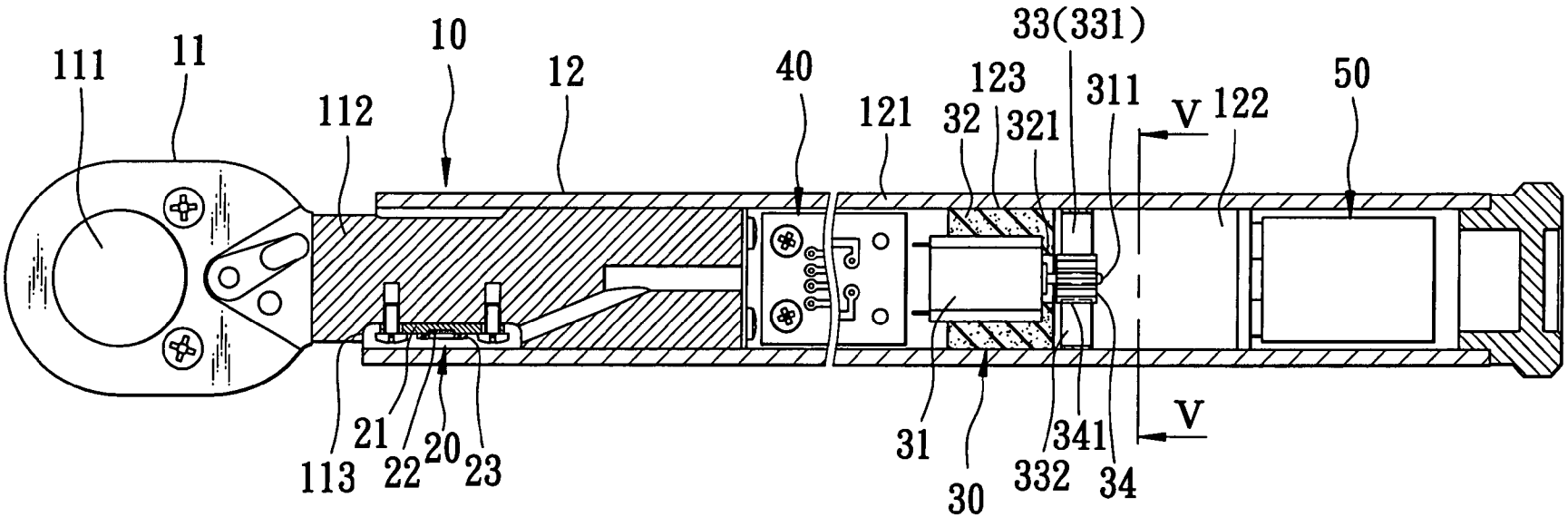
FIG. 4 is a fragmentary sectional view of the first preferred embodiment in an assembled state.
Figure 5:
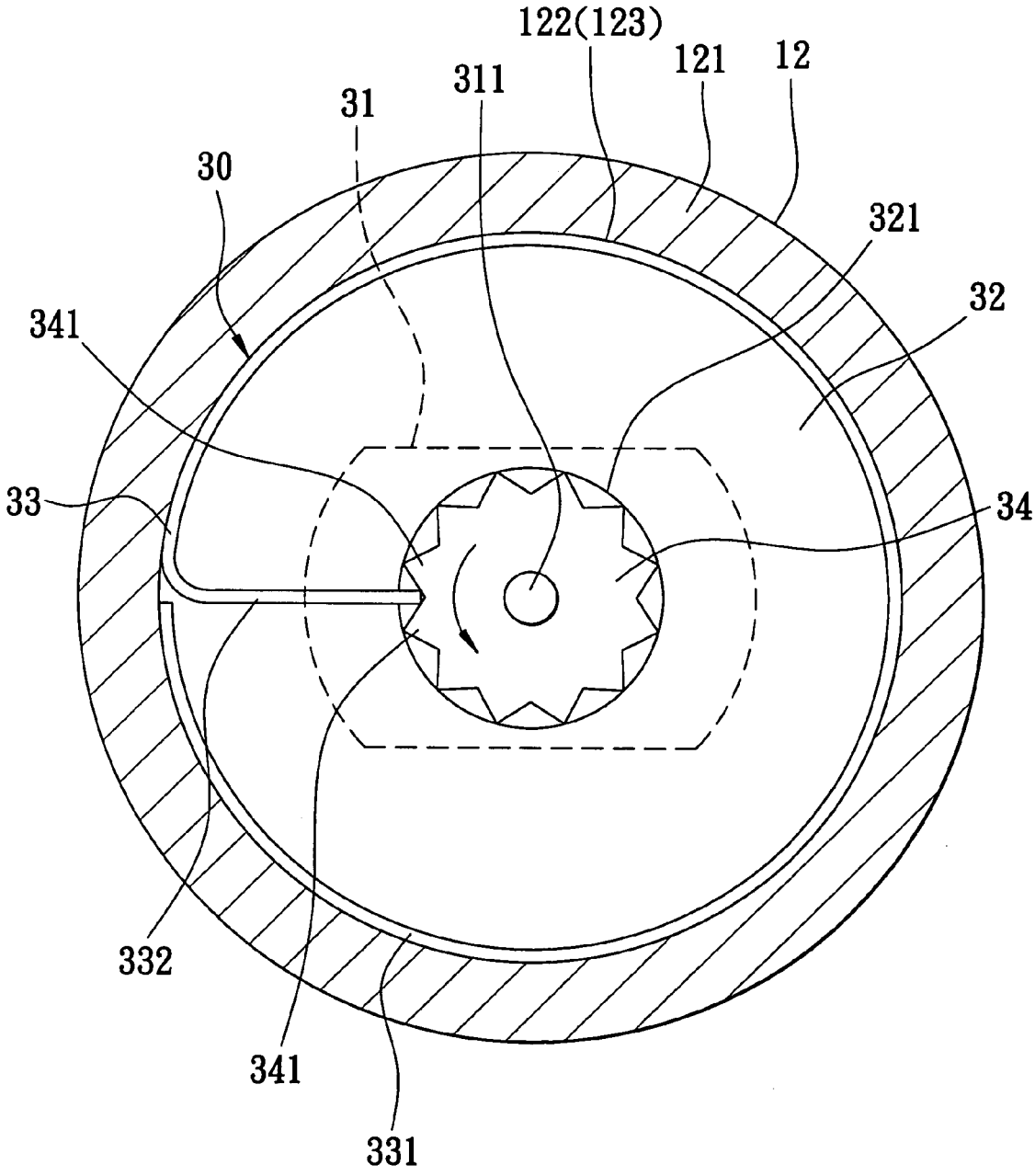
FIG. 5 is a sectional view of the first preferred embodiment taken along line V-V of FIG. 4.
Figure 6:
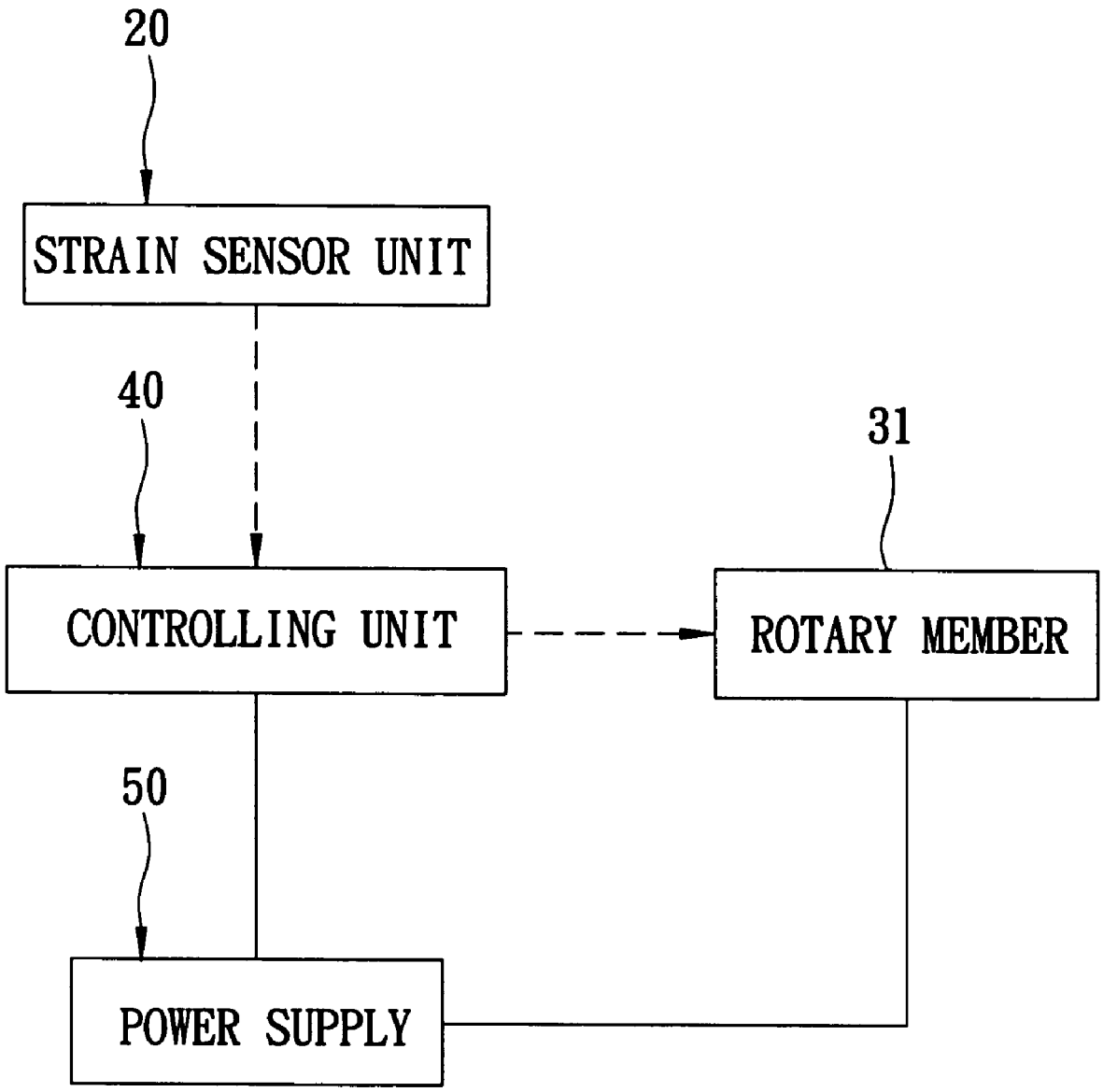
FIG. 6 is a schematic block diagram of the first preferred embodiment, illustrating electrical connections among a strain sensor unit, a controlling unit, a power supply, and a rotary member.

Before the present invention is described in greater detail, it should be noted that like elements are denoted by the same reference numerals throughout the disclosure.

Referring to FIGS. 2 to 6, the first preferred embodiment of an electronic torque wrench according to the present invention is shown to comprise a main body 10, a strain sensor unit 20, an indicator unit 30, and a controlling unit 40.

The main body 10 includes a head portion 11, and a handle portion 12 connected to the head portion 11. The head portion 11 has a ratchet head 111, and a deflection beam 112 extending outwardly from the ratchet head 111. The handle portion 12 has a tubular wall 121 defining a receiving space 122. The deflection beam 112 is partially inserted into a front portion of the receiving space 122, and has a cutout portion 113 provided on a side surface thereof.

The strain sensor unit 20 includes a strain body 21 screwed to an end wall of the cutout portion 113, an integrated chip strain gauge 22 attached to the strain body 21, and a cover plate 23 fixed to an outer surface of the strain body 21. In this embodiment, the integrated chip strain gauge 22 includes a plurality of resistors formed on a substrate using a micro electromechanical system (MEMS) technology, and is connected electrically to contact points 231 of the cover plate 23.

The indicator unit 30 is disposed in the receiving space 122, and includes a rotary member 31 having a rotatable portion 311, a plastic sleeve 32, a first indicator 33, and a second indicator 34.

In this embodiment, the rotary member 31 is a motor, and the rotatable portion 311 is a spindle. The plastic sleeve 32 is sleeved around the rotary member 31, is inserted into the receiving space 122, and has a through hole 321 for extension of the spindle therethrough. The second indicator 34 is made of metal, is fixed to the rotatable portion 311, and has a plurality of angularly spaced-apart and radially and outwardly projecting teeth 341. The first indicator 33 is made of metal, and has a spring ring 331 sleeved into an inner wall face 123 of the tubular wall 121 and disposed around the teeth 341, and a spring plate 332 extending radially from the spring ring 331 toward the teeth 341. When the rotatable portion 311 is rotated, the spring plate 332 strikes consecutively the teeth 341 so as to produce a sound.

The controlling unit 40 is disposed in the receiving space 122 of the handle portion 12, and is connected electrically to the integrated chip strain gauge 22 and the rotary member 31. In this embodiment, the controlling unit 40 is conventional, and has conventional components, such as a circuit board, a Wheatstone bridge, an amplifier, a recorder, a microprocessor, etc. Hence, the controlling unit 40 is not detailed herein.

A power supply 50 is disposed in the receiving space 122 of the handle 12, and is connected electrically to the rotary member 31 and the controlling unit 40. In this embodiment, the power supply 50 is exemplified as a battery.

When a user rotates a workpiece (not shown) using the electronic torque wrench of the present invention, the integrated chip strain gauge 22 transmits a signal in terms of changes in resistance to the controlling unit 40. The controlling unit 40 then determines the torque borne by the electronic torque wrench of the present invention according to the received signal. If the torque is higher than a reference torque level, the controlling unit 40 will actuate the rotatable portion 311 to rotate so that the spring plate 332 will strike consecutively the teeth 341, thereby producing simultaneously a vibration and a continuous clicking sound to warn the user to stop his operation.

From the aforementioned description, it is apparent that through the continuous striking of the spring plate 332 on the teeth 341 of the second indicator 34 when the rotatable portion 311 is rotated, the user not only can feel the vibration, but can also hear the continuous clicking sound produced therefrom. Note that the strain sensor unit 20, the indicator unit 30, the controlling unit 40, and the power supply 50 are provided with proper electrical connections, which are conventional and are omitted herein for simplicity.

Figure 7:
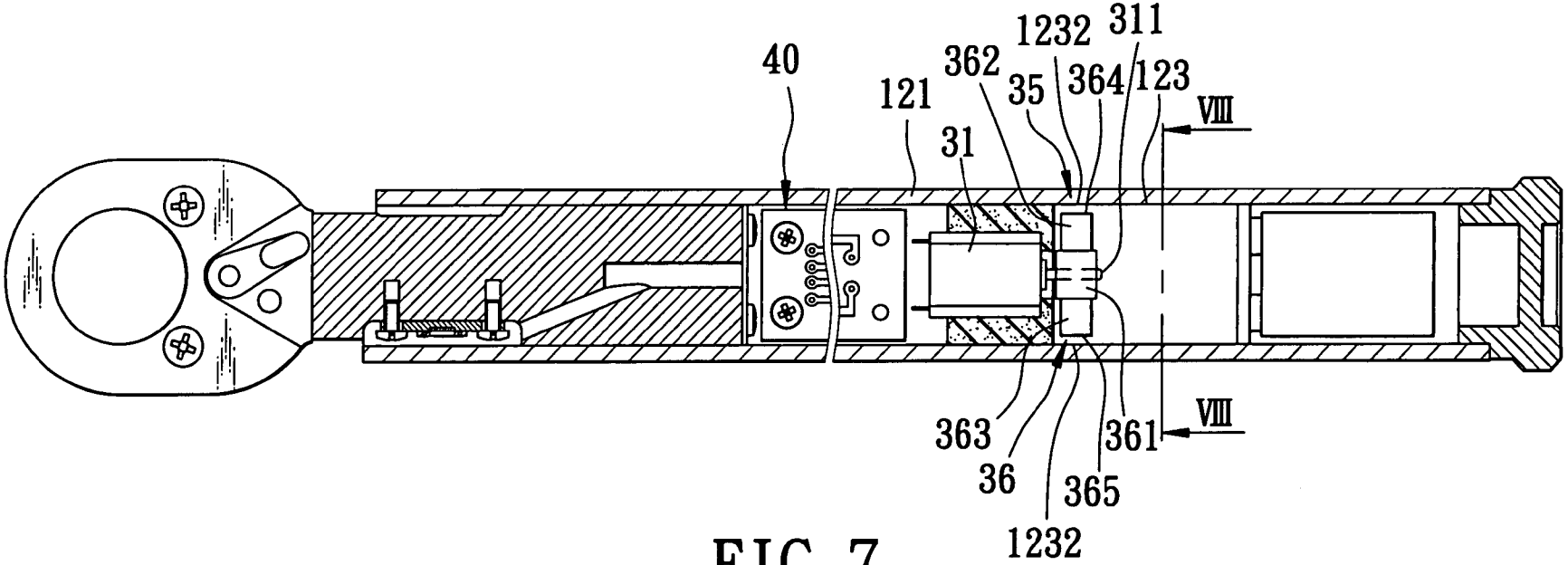
FIG. 7 is a fragmentary sectional view of the second preferred embodiment of an electronic torque wrench according to the present invention.
Figure 8:
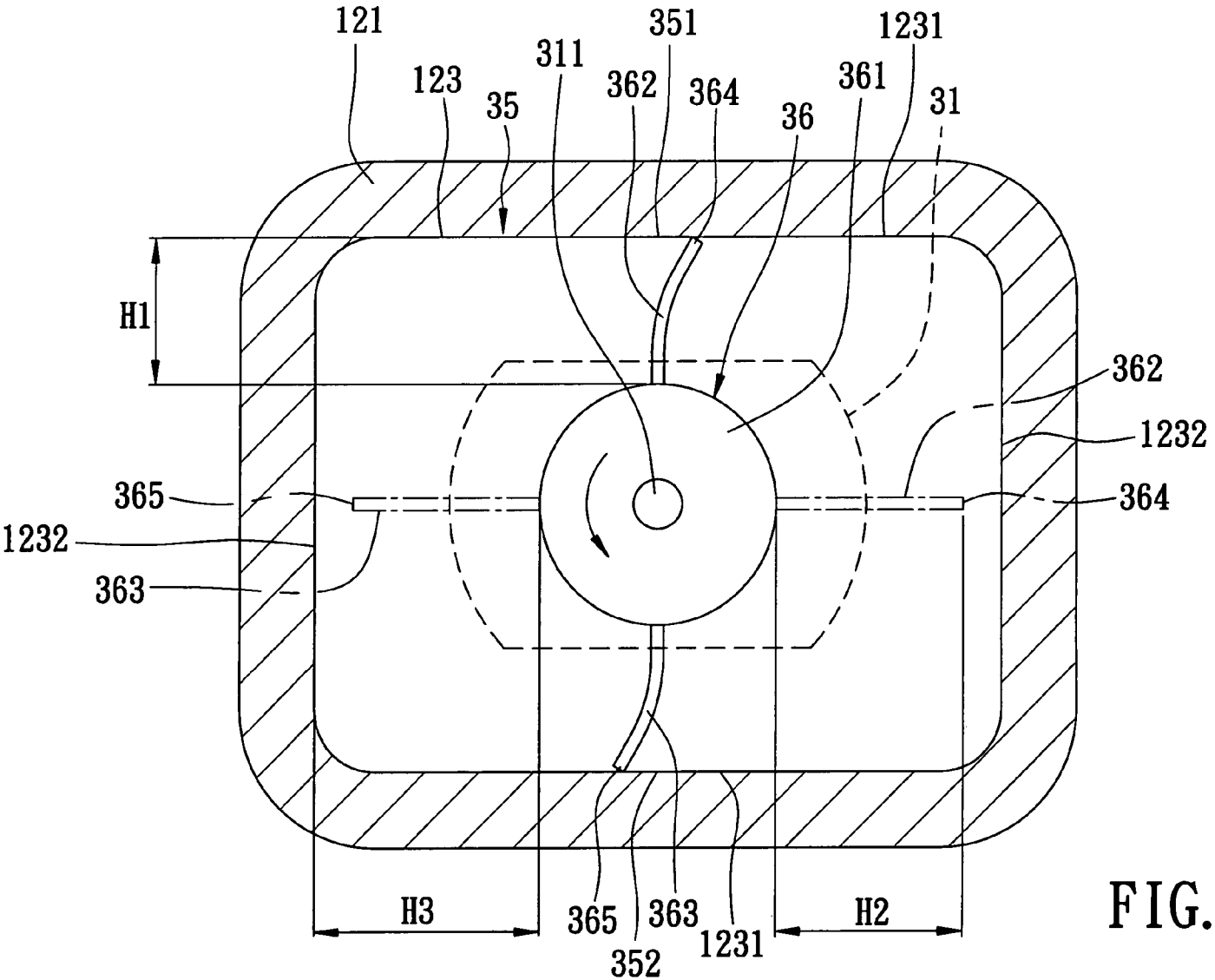
FIG. 8 is a sectional view of the second preferred embodiment taken along line VIII-VIII of FIG. 7.

Referring to FIGS. 7 and 8, the second preferred embodiment of an electronic torque wrench according to the present invention is shown to be similar to the first preferred embodiment. However, in this embodiment, the first indicator 35 has first and second striking faces 351, 352 disposed on the inner wall face 123 of the tubular wall 121 and spaced apart angularly from each other along the tubular wall 121. The second indicator 36 has a fixed portion 361 fixed to the rotatable portion 311 of the rotary member 31, and first and second spring plates 362, 363 extending outwardly and radially from the fixed portion 361 and spaced apart angularly from each other.

The first and second striking faces 351, 352 may be in any suitable form. In this embodiment, the inner wall face 123 of the tubular wall 121 is polygonal, particularly rectangular, and has four sides 1231, 1232. Each side 1231 has a distance (H1) from the fixed portion 361, which is smaller than a distance (H3) of the other sides 1232 of the inner wall face 123 from the fixed portion 361. The first and second striking faces 351, 352 of the first indicator 35 are defined respectively by the sides 1231 of the inner wall face 123. Each of the first and second spring plates 362, 363 has a length (H2), which is larger than the distance (H1), but smaller than the distance (H3). As such, when the controlling unit 40 actuates the rotatable portion 311 to rotate, free ends 364, 365 of the first and second spring plates 362, 363 can strike intermittently the sides 1231 of the inner wall face 123, but not strike the sides 1232 of the inner wall face 123. When the free ends 364, 365 of the first and second spring plates 362, 363 strike intermittently the sides 1231 of the inner wall face 123, i.e., the first and second striking faces 351, 352 of the first indicator 35, a vibration and a continuous clicking sound are simultaneously produced.

The advantages of the first preferred embodiment can be achieved using the second preferred embodiment.

Figure 9:
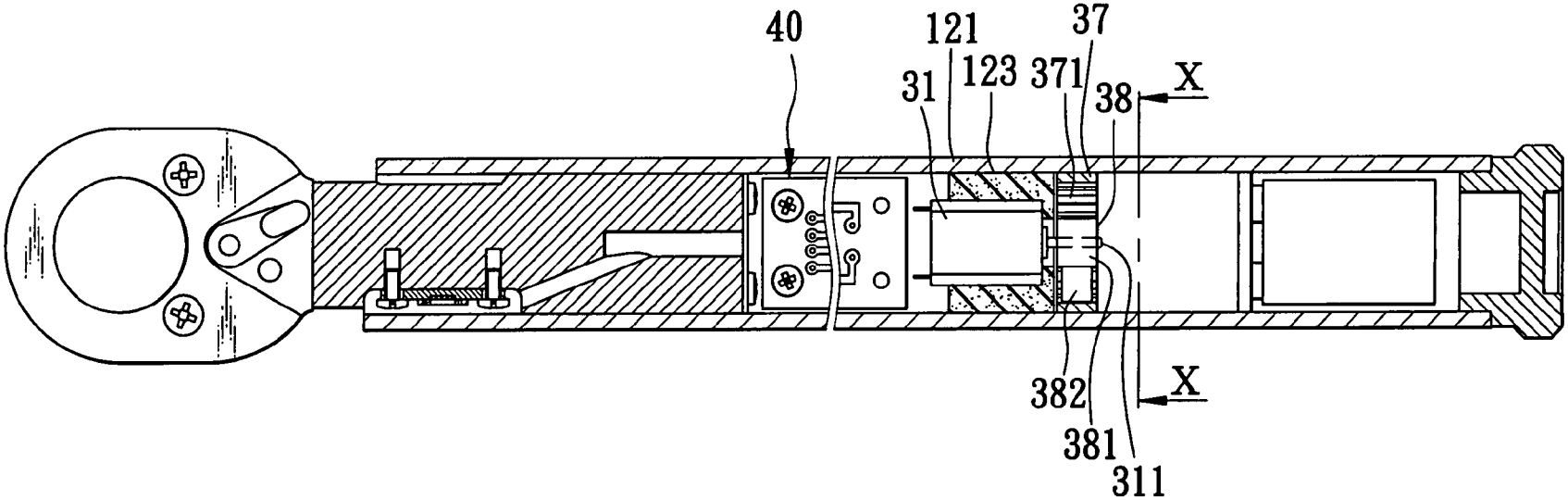
FIG. 9 is a fragmentary sectional view of the third preferred embodiment of an electronic torque wrench according to the present invention.
Figure 10:
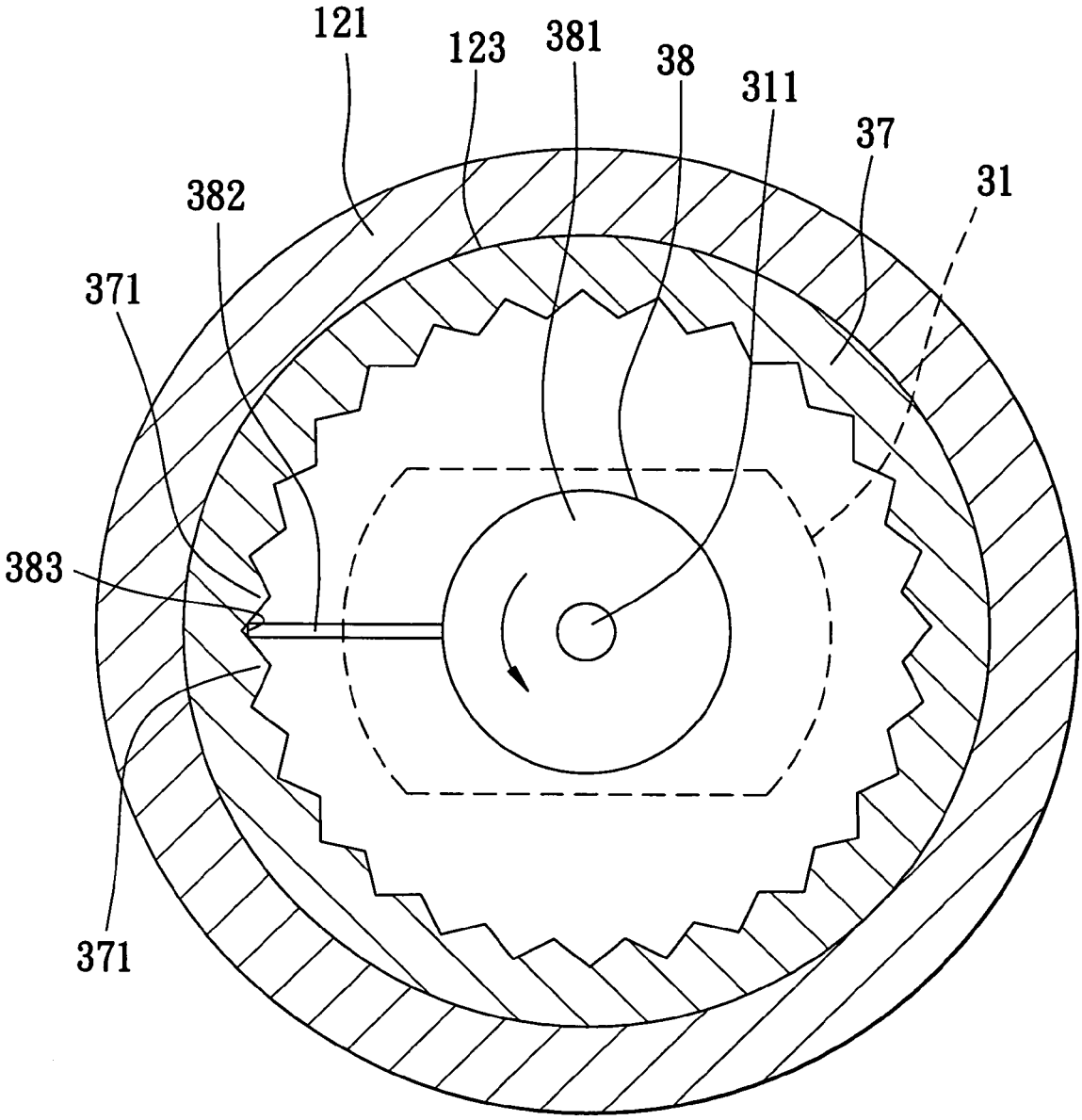
FIG. 10 is a sectional view of the third preferred embodiment taken along line X-X of FIG. 9.

Referring to FIGS. 9 and 10, the third preferred embodiment of an electronic torque wrench according to the present invention is shown to be similar to the first preferred embodiment. However, in this embodiment, the first indicator 37 is sleeved into the inner wall face 123 of the tubular wall 121, and has a plurality of annularly spaced-apart and radially and inwardly projecting teeth 371. The second indicator 38 has a fixed portion 381 fixed to the rotatable portion 311 of the rotary member 31, and a spring plate 382 extending outwardly and radially from the fixed portion 381 and having a free end 383 extending in between the teeth 371. When the controlling unit 40 actuates the rotatable portion 311 to rotate, the spring plate 382 can strike consecutively the teeth 371, thereby producing a vibration and a continuous clicking sound.

The advantages of the first preferred embodiment can be similarly achieved using the third preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electronic torque wrench comprising:

a main body including a head portion, and a handle portion connected to said head portion, said handle portion having a tubular wall that defines a receiving space;

a strain sensor unit disposed in said head portion;

an indicator unit disposed in said receiving space, and including a rotary member having a rotatable portion, a first indicator connected to said tubular wall, and a second indicator fixed to said rotatable portion, said first and second indicators striking each other to produce a sound when said rotatable portion is rotated; and a controlling unit disposed in said main body and connected electrically to said strain sensor unit and said rotary member, said controlling unit actuating said rotatable portion of said rotary member to rotate when said strain sensor unit detects a torque that is larger than a reference torque level.

2. The electronic torque wrench of claim 1, wherein said second indicator has a plurality of angularly spaced-apart teeth around said rotatable portion, said first indicator including a spring ring sleeved into said tubular wall and disposed around said teeth, and a spring plate extending radially from said spring ring toward said teeth so as to strike consecutively said teeth when said rotatable portion is rotated.

3. The electronic torque wrench of claim 1, wherein said first indicator has at least one striking face disposed on an inner wall face of said tubular wall, said second indicator having a fixed portion fixed to said rotatable portion, and at least one spring plate extending outwardly and radially from said fixed portion and having a free end, said free end of said spring plate striking intermittently said striking face when said rotatable portion is rotated.

4. The electronic torque wrench of claim 3, wherein said first indicator has a plurality of said striking faces spaced apart angularly from each other along said tubular wall, said second indicator having a plurality of said spring plates extending outwardly and radially from said fixed portion and spaced apart angularly from each other.

5. The electronic torque wrench of claim 3, wherein said inner wall face of said tubular wall is polygonal, and includes at least one side having a distance from said fixed portion which is smaller than distances of the other sides of said inner wall face from said fixed portion, said striking face being defined by said one side of said inner wall face.

6. The electronic torque wrench of claim 1, wherein said first indicator is sleeved into said tubular wall, and has a plurality of annularly spaced-apart and radially and inwardly projecting teeth, said second indicator having a fixed portion fixed to said rotatable portion, and a spring plate extending outwardly and radially from said fixed portion and having a free end to extend in between said teeth, said spring plate striking consecutively said teeth when said rotatable portion is rotated.

7. The electronic torque wrench of claim 1, wherein said head portion has a deflection beam, said strain sensor unit including a strain body connected to said deflection beam, an integrated chip strain gauge attached to said strain body, and a cover plate fixed to said strain body.

8. The electronic torque wrench of claim 1, wherein said controlling unit is disposed in said receiving space of said handle portion.

9. The electronic torque wrench of claim 1, wherein said rotary member is a motor, and said rotatable portion is a spindle.

10. The electronic torque wrench of claim 9, wherein said indicator unit further includes a plastic sleeve sleeved around said motor and having a through hole for extension of said spindle therethrough, said plastic sleeve being inserted into said receiving space.

11. The electronic torque wrench of claim 1, further comprising a power supply disposed in said receiving space and connected electrically to said rotary member and said controlling unit.

* * * * *